US011819978B2

(12) United States Patent
Takagi et al.

(10) Patent No.: US 11,819,978 B2
(45) Date of Patent: Nov. 21, 2023

(54) GRINDING MATERIAL

(71) Applicant: BANDO CHEMICAL INDUSTRIES, LTD., Hyogo (JP)

(72) Inventors: Daisuke Takagi, Kobe (JP); Tomoki Iwanaga, Kobe (JP); Kazuo Saito, Kobe (JP); Toshikazu Taura, Kobe (JP)

(73) Assignee: BANDO CHEMICAL INDUSTRIES, LTD., Hyogo (JP)

( * ) Notice: Subject to any disclaimer, the term of this patent is extended or adjusted under 35 U.S.C. 154(b) by 1153 days.

(21) Appl. No.: 16/088,083

(22) PCT Filed: Jan. 19, 2017

(86) PCT No.: PCT/JP2017/001708
§ 371 (c)(1),
(2) Date: Sep. 25, 2018

(87) PCT Pub. No.: WO2017/163565
PCT Pub. Date: Sep. 28, 2017

(65) Prior Publication Data

US 2020/0298374 A1 Sep. 24, 2020

(30) Foreign Application Priority Data

Mar. 25, 2016 (JP) ..... 2016-061324

(51) Int. Cl.
*B24D 11/04* (2006.01)
*B24D 3/28* (2006.01)

(52) U.S. Cl.
CPC ..... *B24D 11/04* (2013.01); *B24D 3/28* (2013.01)

(58) Field of Classification Search
CPC ..... B24D 11/00; B24D 11/04; B24D 3/00; B24D 3/28; B24D 11/001; B24D 18/00;
(Continued)

(56) References Cited

U.S. PATENT DOCUMENTS 5,314,514 A * 5/1994 Sato ..... B24D 11/00 106/3
5,387,457 A 2/1995 Sato
(Continued)

FOREIGN PATENT DOCUMENTS

CN 102822110 12/2012
CN 104487395 4/2015
(Continued)

*Primary Examiner* — Joel D Crandall
*Assistant Examiner* — Abbie E Quann
(74) *Attorney, Agent, or Firm* — JCIPRNET

(57) ABSTRACT

A grinding material includes a base sheet and a grinding layer overlaid on a front face side of the base sheet and including abrasive grains and a binder for the abrasive grains. The grinding layer includes the abrasive grains of a plurality of types. Of the abrasive grains of the plurality of types, provided that first abrasive grains have the largest average diameter and second abrasive grains have the second largest average diameter, the percentage of the average diameter of the second abrasive grains with respect to that of the first abrasive grains is 5-70%. The total content of the abrasive grains in the grinding layer is preferably 50-85% by volume. The content of the first abrasive grains in the grinding layer is preferably 1-25% by volume. The first abrasive grains are preferably diamond abrasive grains and the second abrasive grains are preferably alumina abrasive grains.

8 Claims, 1 Drawing Sheet

(58) Field of Classification Search
CPC ..... B24D 18/0072; B24D 3/06; B24D 7/14; B24B 37/245; B24B 37/044; B24B 37/24
USPC ..... 51/295, 309, 308, 533, 526
See application file for complete search history.

(56) References Cited

U.S. PATENT DOCUMENTS

| | | | | |
|---|---|---|---|---|
| 5,942,015 | A * | 8/1999 | Culler | B24D 18/00 51/297 |
| 6,435,958 | B1 * | 8/2002 | Damgaard | B24B 37/245 451/526 |
| 7,951,213 | B1 * | 5/2011 | Miess | E21B 10/567 175/428 |
| 2006/0135050 | A1 * | 6/2006 | Petersen | B24D 15/04 451/523 |
| 2011/0042148 | A1 * | 2/2011 | Schmitz | E21B 10/567 175/428 |
| 2018/0117737 | A1 * | 5/2018 | Wang | B24D 3/14 |
| 2019/0061107 | A1 * | 2/2019 | Everts | B24D 3/28 |

FOREIGN PATENT DOCUMENTS

| | | |
|---|---|---|
| JP | 57-096780 | 6/1982 |
| JP | 03-073275 | 3/1991 |
| JP | 04-250979 | 9/1992 |
| JP | 06-039736 | 2/1994 |
| JP | 2001516652 | 10/2001 |
| JP | 2015-178155 | 10/2015 |

* cited by examiner

GRINDING MATERIAL

CROSS-REFERENCE TO RELATED APPLICATION

This application is a 371 application of the international PCT application serial no. PCT/JP2017/001708, filed on Jan. 19, 2017, which claims the priority benefit of Japan Patent Application No. 2016-061324, filed on Mar. 25, 2016. The entirety of each of the above-mentioned patent applications is hereby incorporated by reference herein and made a part of this specification.

TECHNICAL FIELD

The present invention relates to a grinding material.

BACKGROUND ART

In recent years, electronic devices such as hard disks have achieved enhanced precision. Glass is typically used as a material of a substrate of such an electronic device, in light of stiffness, impact resistance and heat resistance required of smaller and thinner devices. The glass substrate is a fragile material. The mechanical strength of the glass substrate would be impaired significantly if the surface of the substrate is scratched. Thus, such a substrate needs to be ground with a high grinding rate and a high degree of planarization accuracy while being impervious to scratches.

Furthermore, running costs in grinding glass substrates for industrial use need to be reduced in light of productivity improvement. The running costs include costs of consumable items such as grinding materials, costs of dressing, and the like. Dressing is the process of trimming the surface of a grinding material to recover a loss in grinding rate resulting from dull abrasive grains and to expose fresh abrasive grains. The grinding material is cleaned before and after the dressing. The grinding action on a workpiece, i.e., the glass substrate is suspended while the dressing is conducted.

Proposed as a grinding material with which both the desired grinding rate and the planarization accuracy as well as the reduction in running costs can be achieved is a grinding material including a grinding portion in which abrasive grains and a filler are dispersed (see Japanese Unexamined Patent Application, Publication No. 2015-178155). During the grinding action, the filler comes off and a recessed part curved along a spherical crown shape is formed on the top face of the grinding portion accordingly. Consequently, the grinding portion has a reduced area of contact with the workpiece and thus resists wearing out. Therefore, this conventional grinding material is long lasting. Thus, such a grinding material needs replacing less frequently. Of the running costs, the costs of the grinding material will be reduced accordingly. Owing to the reduced area of contact with the workpiece, the grinding portion effectively receives grinding pressure, and thus both the desired grinding rate and the planarization accuracy are achieved at the same time.

The grinding portion resists wearing out, and thus the conventional grinding material holds, for a relatively long period of time, the abrasive grains exposed at the surface of the grinding portion and principally contributing to the grinding action. The abrasive grains exposed at the grinding portion of the conventional grinding material tend to become dull quickly due to the grinding action. This means that the grinding rate tends to drop in the course of the grinding action, and as a result, the conventional grinding material fails to reduce the frequency of conducting dressing. With regard to the running costs, there is still a room for improvement in terms of the costs of dressing.

PRIOR ART DOCUMENTS

Patent Documents

Patent Document 1: Japanese Unexamined Patent Application, Publication No. 2015-178155

SUMMARY OF THE INVENTION

Problems to be Solved by the Invention

The present invention has been made in view of the foregoing disadvantages, and it is an object of the present invention to provide a grinding material usable without significant decrease in grinding rate over a relatively long period of time.

Means for Solving the Problems

According to an aspect of the invention made for solving the aforementioned problems, a grinding material includes a base sheet and a grinding layer overlaid on a front face side of the base sheet and including abrasive grains and a binder for the abrasive grains. The grinding layer includes the abrasive grains of a plurality of types. Of the abrasive grains of the plurality of types, provided that first abrasive grains have the largest average diameter and second abrasive grains have the second largest average diameter, the percentage of the average diameter of the second abrasive grains with respect to the average diameter of the first abrasive grains is no less than 5% and no greater than 70%.

The grinding material includes the abrasive grains of the plurality of types. With suitable types of abrasive grains selected, the grinding material is capable of attaining desired grinding performance balanced with the production costs. In the grinding material, the percentage of the average diameter of the second abrasive grains with respect to the average diameter of the first abrasive grains is no greater than the upper limit. Thus, shedding of the first abrasive grains out of a grinding layer tends to be preceded by shedding of the second abrasive grains of which the average diameter is smaller than the average diameter of the first abrasive grains. In the grinding material, the percentage of the average diameter of the second abrasive grains with respect to the average diameter of the first abrasive grains is no less than lower limit. Thus, shedding of the second abrasive grains results in an appropriate degree of spalling of part of the grinding layer. As a result of the spalling, dulling proceeds on the grinding material, causing shedding of the first abrasive grains of which the cutting performance has become relatively poor. This allows exposure of fresh abrasive grains. Consequently, the proportion of abrasive grains providing superior cutting performance in the abrasive grains on the front face of the grinding layer is increased, thereby inhibiting a reduction in grinding rate that might otherwise occur in an overly advanced stage of dulling of abrasive grains.

The total content of the abrasive grains in the grinding layer is preferably no less than 50% by volume and no greater than 85% by volume. When the total content of the abrasive grains falls within the above range, the binder can hold the abrasive grains in a more favorable manner, with an appropriate degree of shedding of abrasive grains. Thus, the effect of inhibiting a reduction in grinding rate can be enhanced while the grinding layer resists wearing out.

The content of the first abrasive grains in the grinding layer is preferably no less than 1% by volume and no greater than 25% by volume. When the content of the abrasive first abrasive grains falls within the above range, a more favorable degree of shedding of the first abrasive grains can be achieved due to shedding of the second abrasive grains while the grinding performance is maintained. Thus, the effect of inhibiting a reduction in grinding rate can be enhanced.

It is preferred that the first abrasive grains are diamond abrasive grains and the second abrasive grains are alumina abrasive grains. The diamond abrasive grains, which are superior in cutting performance to the alumina abrasive grains, are expensive. The grinding performance of the grinding material depends mainly on the first abrasive grains having a larger average diameter. Thus, through the use of diamond abrasive grains as the first abrasive grains and the use of alumina abrasive grains as the second abrasive grains, the cost of production of the grinding material can be further reduced while the grinding performance is maintained.

The content of abrasive grains other than the first abrasive grains in the grinding layer is preferably no less than 30% by volume and no greater than 80% by volume. When the content of abrasive grains other than the first abrasive grains falls within the above range, the degree of spalling of the grinding layer can be more favorably controlled, and thus a reduction in grinding rate can be further inhibited.

The term "average diameter" as referred to herein means the value at 50% (the grain diameter at 50%, D50) on the cumulative grain size distribution curve based on the volume as measured by, for example, laser diffraction.

Effects of the Invention

As described in the foregoing, the grinding material according to the aspect of the present invention is usable without significant decrease in grinding rate over a relatively long period of time. Thus, when the grinding material according to the aspect of the present invention is used in the grinding, the frequency of conducting dressing can be reduced, leading to a reduction in the running costs associated with the dressing.

DESCRIPTION OF EMBODIMENTS

Embodiments of the present invention will be described below in detail with appropriate references to the drawings.

Figure 1:
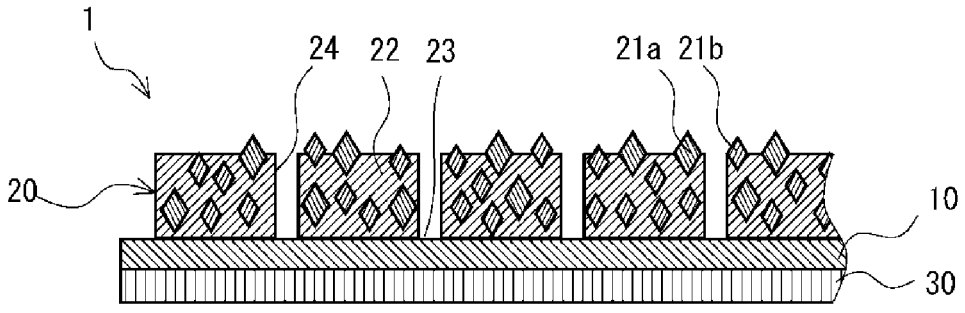
FIG. 1 is a schematic cross-sectional view of a grinding material according to an embodiment of the present invention.

A grinding material 1 shown in FIG. 1 includes a base sheet 10, a grinding layer 20 overlaid on the front face side of the base sheet 10, and an adhesive layer 30 overlaid on the back face side of the base sheet 10. The grinding material 1 is used as a fixed-abrasive grinding material for substrate processing.

Base Sheet

The base sheet 10 is a member for supporting the grinding layer 20.

The principal component of the base sheet 10 is not particularly limited, and examples thereof include polyethylene terephthalate (PET), polypropylene (PP), polyethylene (PE), polyimide (PI), polyethylene naphthalate (PEN), aramid, aluminum, copper, and the like. Of these, PET and aluminum that offer superior adhesion to the grinding layer 20 are preferred. The front face of the base sheet 10 may be subjected to a treatment for enhancing adhesion such as a chemical treatment, a corona treatment, or a primer treatment. The term "principal component" herein means a component contained in the highest proportion, and refers to a component present in a proportion of, for example, no less than 50% by mass and preferably no less than 90% by mass.

The base sheet 10 preferably has flexibility or ductility. When the base sheet 10 has flexibility or ductility, the grinding material 1 follows the surface profile of a workpiece and thus the contact area between the grinding face and the workpiece increases, leading to further improvement of the grinding rate. Examples of the principal component of the base sheet 10 having flexibility include PET, PI, and the like. Examples of the principal component of the base sheet 10 having ductility include aluminum, copper, and the like.

The shape and size of the substrate sheet 10 is not particularly limited, and the substrate sheet 10 may have a square shape measuring no less than 140 mm and no greater than 160 mm per side, or a circular shape with an outer diameter of no less than 200 mm and no greater than 2,100 mm and an inner diameter of no less than 100 mm and no greater than 660 mm. Alternatively, a plurality of base sheets 10 aligned on a planar surface may be supported by a single support.

The average thickness of the base sheet 10 is not particularly limited, and may be, for example, no less than 50 μm and no greater than 1 mm. When the average thickness of the base sheet 10 is less than the lower limit, the strength and/or the planarity of the grinding material 1 may be insufficient. When the average thickness of the base sheet 10 is greater than the upper limit, the grinding material 1 may be unduly thick and difficult to handle.

Grinding Layer

The grinding layer 20 includes abrasive grains and a binder 22 for the abrasive grains. The abrasive layer 20 includes, on the front face thereof, a plurality of protruding portions 24 divided by grooves 23.

The lower limit of the average thickness of the grinding layer 20 (the average thickness of the protruding portions 24 alone) is preferably 25 μm, more preferably 30 μm, and still more preferably 50 μm. The upper limit of the average thickness of the grinding layer 20 is preferably 4,000 μm, more preferably 3,500 μm, and still more preferably 3,000 μm. When the average thickness of the grinding layer 20 is less than the lower limit, the durability of the grinding layer 20 may be insufficient. When the average thickness of the grinding layer 20 is greater than the upper limit, the homogeneity of the grinding layer 20 may be poor, and it may be thus difficult to ensure the stable grinding performance. Furthermore, the grinding material 1 may be unduly thick and difficult to handle. In addition, the production costs may increase.

Abrasive Grains

The grinding layer 20 includes at least two types of abrasive grains. Specifically, the grinding layer 20 at least includes first abrasive grains 21*a* having a larger average diameter and second abrasive grains 21*b* having an average diameter smaller than that of the first abrasive grains 21*a*.

Examples of the abrasive grains include diamond abrasive grains, alumina abrasive grains, silica abrasive grains, ceria abrasive grains, silicon carbide abrasive grains, boron carbide abrasive grains, and the like. Of these, diamond abrasive grains and silicon carbide abrasive grains are preferred as the first abrasive grains 21*a*, and alumina abrasive grains, silica abrasive grains and ceria abrasive grains are preferred as the second abrasive grains 21*b*. It is particularly preferred that the first abrasive grains 21*a* are diamond abrasive grains and the second abrasive grains 21*b* are alumina abrasive grains. The diamond abrasive grains, which are superior in cutting performance to the alumina abrasive grains, are expensive. The grinding performance depends mainly on the first abrasive grains 21*a* having a larger average diameter. Thus, through the use of diamond abrasive grains as the first abrasive grains 21*a* and the use of alumina abrasive grains as the second abrasive grains 21*b*, the cost of production of the grinding material 1 can be further reduced while the grinding performance owing to the diamond abrasive grains is maintained. In the case where diamond abrasive grains are to be used, diamonds may be monocrystalline or polycrystalline, or may be Ni-coated or subjected to other treatments. In particular, monocrystalline diamonds and polycrystalline diamonds are preferred. Monocrystalline diamonds are particularly hard diamonds and capable of providing superior cutting performance. Polycrystalline diamonds are easily cleaved between microcrystals constituting a polycrystal and can thus resist dulling, so that the grinding rate will not be reduced significantly.

The average diameter of the first abrasive grains 21*a* is appropriately selected in view of the grinding speed and the surface roughness of the ground workpiece. The lower limit of the average diameter of the first abrasive grains 21*a* is preferably 1 μm, and more preferably 2 μm. The upper limit of the average diameter of the first abrasive grains 21*a* is preferably 45 μm, more preferably 30 μm, and still more preferably 25 μm. When the average diameter of the first abrasive grains 21*a* is less than the lower limit, the grinding performance of the grinding material 1 may be insufficient and thus the grinding efficiency may be impaired. When the average diameter of the first abrasive grains 21*a* is greater than the upper limit, the grinding accuracy may be impaired.

The average diameter of the second abrasive grains 21*b* is smaller than the average diameter of the first abrasive grains 21*a*. The lower limit of the average diameter of the second abrasive grains 21*b* is preferably 0.5 μm, and more preferably 1 μm. The upper limit of the average diameter of the second abrasive grains 21*b* is preferably 20 μm, more preferably 10 μm, and still more preferably 5 μm. When the average diameter of the second abrasive grains 21*b* is less than the lower limit, spalling of the grinding layer 20 may proceed too quickly, so that the grinding material 1 may be short lasting. When the average diameter of the second abrasive grains 21*b* is greater than the upper limit, the degree of spalling of the grinding layer 20 caused by shedding of the second abrasive grains 21*b* may be insufficient, and the effect of inhibiting a reduction in grinding rate may be insufficient accordingly.

The lower limit of the percentage of the average diameter of the second abrasive grains 21*b* with respect to the average diameter of the first abrasive grains 21*a* may be 5%, and is more preferably 10% and still more preferably 15%. The upper limit of the percentage of the average diameter of the second abrasive grains 21*b* may be 70%, and is more preferably 65% and still more preferably 60%. When the percentage of the average diameter of the second abrasive grains 21*b* is less than the lower limit, shedding of the second abrasive grains 21*b* may occur excessively and thus spalling of the grinding layer 20 proceeds too quickly, so that the grinding material 1 may be short lasting. When the percentage of the average diameter of the second abrasive grains 21*b* is greater than the upper limit, the degree of spalling of the grinding layer 20 caused by shedding of the second abrasive grains 21*b* may be insufficient, and the effect of inhibiting a reduction in grinding rate may be insufficient accordingly. Furthermore, the difference between the average diameter of the second abrasive grains 21*b* and the average diameter of the first abrasive grains 21*a* is reduced, and thus the second abrasive grains 21*b* are also prone to receive the grinding pressure during the grinding action. Consequently, the grinding pressure applied on the individual first abrasive grains 21*a* during the grinding action may be reduced, and the grinding rate may be reduced accordingly.

The lower limit of the total content of the abrasive grains in the abrasive layer 20 is preferably 50% by volume, and more preferably 55% by volume. The upper limit of the total content of the abrasive grains is preferably 85% by volume, and more preferably 70% by volume. When the total content of the abrasive grains is less than the lower limit, the content of the binder 22 is large in relative terms, allowing the abrasive grains to be fixed firmly and to resist shedding accordingly. Consequently, the proportion of abrasive grains that have yet to become dull and are thus capable of providing superior cutting performance in the abrasive grains on the front face of the grinding layer 20 may be reduced, and thus the effect of inhibiting a reduction in grinding rate may be insufficient. When the total content of the abrasive grains is greater than the upper limit, the content of the binder 22 is small in relative terms, and thus shedding of the abrasive grains is likely to occur. Consequently, spalling of the grinding layer 20 proceeds too quickly, so that the grinding material 1 may be short lasting.

The lower limit of the content of the first abrasive grains 21*a* in the grinding layer 20 is preferably 1% by volume, and more preferably 2% by volume. The upper limit of the content of the first abrasive grains 21*a* is preferably 25% by volume, more preferably 15% by volume, and still more preferably 10% by volume. When the content of the first abrasive grains 21*a* is less than the lower limit, the grinding performance of the grinding material 1 may be insufficient. When the content of the first abrasive grains 21*a* is greater than the upper limit, the content of the second abrasive grains 21*b* is small in relative terms, and thus the degree of spalling of the grinding layer 20 caused by shedding of the second abrasive grains 21*b* may be insufficient. Consequently, the effect of inhibiting a reduction in grinding rate may be insufficient. Furthermore, the first abrasive grains 21*a* are packed too densely, so that the grinding pressure applied on the individual first abrasive grains 21*a* during the grinding action may be reduced, and the grinding rate may be reduced accordingly.

The lower limit of the content of the second abrasive grains 21*b* in the grinding layer 20 is preferably 30% by volume, and more preferably 50% by volume. The upper limit of the content of the second abrasive grains 21*b* is preferably 80% by volume, and more preferably 70% by volume. When the content of the second abrasive grains 21*b* is less than the lower limit, the degree of spalling of the grinding layer 20 caused by shedding of the second abrasive grains 21*b* may be insufficient, and the effect of inhibiting a reduction in grinding rate may be insufficient accordingly. When the content of the second abrasive grains 21*b* is greater than the upper limit, spalling of the grinding layer 20 may proceed too quickly, so that the grinding material 1 may be short lasting.

The lower limit of the ratio of the second abrasive grains 21*b* to the content of the first abrasive grains 21*a* is preferably 1, and still more preferably 5. The upper limit of the ratio of the content of the second abrasive grains 21*b* is preferably 25, and more preferably 15. When the ratio of the content of the second abrasive grains 21*b* is less than the lower limit, the degree of spalling of the grinding layer 20 caused by shedding of the second abrasive grains 21*b* may be insufficient, and the effect of inhibiting a reduction in grinding rate may be insufficient accordingly. When ratio of the content of the second abrasive grains 21*b* is greater than the upper limit, spalling of the grinding layer 20 may proceed too quickly, so that the grinding material 1 may be short lasting.

The grinding layer 20 may include one or a plurality of types of third abrasive grains different from the first abrasive grains 21*a* and the second abrasive grains 21*b*, and the average diameter of the third abrasive grains is smaller than the average diameter of the second abrasive grains. When the grinding layer 20 includes the third abrasive grains, better control of the degree of spalling of the grinding layer 20 is provided.

Examples of the third abrasive grains include diamond abrasive grains, alumina abrasive grains, silica abrasive grains, ceria abrasive grains, silicon carbide abrasive grains, boron carbide abrasive grains, and the like. Of these, alumina abrasive grains, silica abrasive grains and ceria abrasive grains that are comparatively inexpensive are preferred.

The lower limit of the average diameter of the third abrasive grains is preferably 0.01 μm, and more preferably 0.02 μm. The upper limit of the average diameter of the third abrasive grains is preferably 2 μm, and more preferably 1.5 μm. When the average diameter of the third abrasive grains is less than the lower limit, spalling of the grinding layer 20 may proceed too quickly, so that the grinding material 1 may be short lasting. When the average diameter of the third abrasive grains is greater than the upper limit, the effect of providing better control of the degree of spalling of the grinding layer 20 may be insufficient. In the case where the third abrasive grains of a plurality of types are included, the average diameter of the third abrasive grains refers to the average diameter of the third abrasive grains of each type.

The lower limit of the percentage of the average diameter of the third abrasive grains with respect to the average diameter of the second abrasive grains 21*b* is preferably 1%, and more preferably 5%. The upper limit of the percentage of the average diameter of the third abrasive grains is preferably 75%, and is more preferably 65%. When the percentage of the average diameter of the third abrasive grains is less than the lower limit, spalling of the grinding layer 20 may proceed too quickly, so that the grinding material 1 may be short lasting. When the percentage of the average diameter of the third abrasive grains is greater than the upper limit, the effect of providing better control of the degree of spalling of the grinding layer 20 may be insufficient.

The lower limit of the content of the third abrasive grains in the grinding layer 20 is preferably 1% by volume, and more preferably 3% by volume. The upper limit of the content of the third abrasive grains is preferably 20% by volume, and more preferably 15% by volume. When the content of the third abrasive grains is less than the lower limit, the effect of providing better control of the degree of spalling of the grinding layer 20 may be insufficient. When the content of the third abrasive grains is greater than the upper limit, spalling of the grinding layer 20 may proceed too quickly, so that the grinding material 1 may be short lasting. In the case where the third abrasive grains of a plurality of types are included, the content of the third abrasive grains refers to the total content which is the sum of the contents of the plurality of types of grains.

In the case where the grinding layer 20 includes the third abrasive grains, the lower limit of the total content of the second abrasive grains 21*b* and the third abrasive grains (the content of abrasive grains other than the first abrasive grains 21*a*) in the grinding layer 20 is preferably 30% by volume, and more preferably 50% by volume. The upper limit of the total content of the second abrasive grains 21*b* and the third abrasive grains is preferably 80% by volume, and more preferably 70% by volume. When the total content of the second abrasive grains 21*b* and the third abrasive grains is less than the lower limit, the degree of spalling of the grinding layer 20 caused by shedding of the second abrasive grains 21*b* and the third abrasive grains may be insufficient, and the effect of inhibiting a reduction in grinding rate may be insufficient accordingly. When the total content of the second abrasive grains 21*b* and the third abrasive grains is greater than the upper limit, spalling of the grinding layer 20 may proceed too quickly, so that the grinding material 1 may be short lasting.

Binder

The principal component of the binder 22 is not particularly limited, and examples thereof include resins such as polyurethane, polyphenol, epoxy, polyester, cellulose, an ethylene copolymer, polyvinyl acetal, polyacrylic acid, polyacrylic ester, polyvinyl alcohol, polyvinyl chloride, polyvinyl acetate and polyamide. Of these, polyacrylic acid, epoxy, polyester and polyurethane, which are more capable of providing favorable adhesion to the base sheet 10, are preferred. At least part of the resin may be crosslinked.

Where appropriate, the binder 22 may further contain, for example, various types of auxiliaries and additives right for the purpose, such as a dispersant, a coupling agent, a surfactant, a lubricant, a defoaming agent and a colorant.

Protruding Portions

The plurality of protruding portions 24 are divided by the grooves 23 that are provided on the front face of the grinding layer 20 so as to form a grid pattern having equal spacing. In other words, the plurality of protruding portions 24 are aligned regularly in a block pattern. Furthermore, the bottom faces of the grooves 23 that divide the protruding portions 24 correspond to the front face of the base 10.

The lower limit of the average width of the grooves 23 is preferably 0.3 mm, and more preferably 0.5 mm. The upper limit of the average width of the grooves 23 is preferably 10 mm, and more preferably 8 mm. When the average width of the grooves 23 is less than the lower limit, the grooves 23 may be clogged with abrasive powder generated due to the grinding action. When the average width of the grooves 23 is greater than the upper limit, the workpiece is likely to be caught in the grooves 23 during the grinding action and thus the workpiece may be scratched.

The lower limit of the average area of the upper faces of the protruding portions 24 is preferably 1 $mm^2$, and more preferably 2 $mm^2$. The upper limit of the average area of the upper faces of the protruding portions 24 is preferably 150 $mm^2$, and more preferably 130 $mm^2$. When the average area of the upper faces of the protruding portions 24 is less than the lower limit, the protruding portion 24 may flake off from the base sheet 10. When the average area of the upper faces of the protruding portions 24 is greater than the upper limit, the grinding layer 20 has a reduced area of contact with the workpiece during the grinding action, so that the grinding pressure applied on the individual first abrasive grains 21*a* during the grinding action may be reduced, and the grinding rate may be reduced accordingly.

The lower limit of the percentage area occupancy of the upper faces of the plurality of protruding portions 24 with respect to the entirety of the grinding layer 20 is preferably 5%, and more preferably 10%. The upper limit of the percentage area occupancy of the upper faces of the plurality of protruding portions 24 with respect to the entirety of the grinding layer 20 is preferably 60%, and more preferably 55%. When the percentage area occupancy of the upper faces of the plurality of protruding portions 24 with respect to the entirety of the grinding layer 20 is less than the lower limit, the protruding portions 24 may flake off from the base sheet 10. When the percentage area occupancy of the upper faces of the plurality of protruding portions 24 with respect to the entirety of the grinding layer 20 is greater than the upper limit, the spacing between the adjacent grooves 23 may be too large, and chips that fall on the front face of the grinding layer 20 may build up on the front face of the grinding layer 20, so that clogging may occur. The expression of "area of the entirety of the grinding layer" encompasses the area of grooves of the grinding layer where applicable.

Adhesive Layer

The adhesive layer 30 fixes the grinding material 1 to a support for supporting the grinding material 1 and attaching it to a grinding apparatus.

The adhesive which may be used as the adhesive layer 30 is not particularly limited, and examples thereof include a reactive adhesive, an instant adhesive, a hot melt adhesive, a tacky adhesive which is a detachable adhesive, and the like.

The adhesive used as the adhesive layer 30 is preferably a tacky adhesive. In the case where the adhesive used as the adhesive layer 30 is a tacky adhesive, the grinding material 1 can be detached from the support and replaced with another, and thus the grinding material 1 and the support can be readily recycled. Such a tacky adhesive is not particularly limited, and examples thereof include an acrylic tacky adhesive, an acryl-rubber tacky adhesive, a natural rubber tacky adhesive, a synthetic rubber tacky adhesive based butyl rubber or the like, a silicone tacky adhesive, a polyurethane tacky adhesive, and the like.

The lower limit of the average thickness of the adhesive layer 30 is preferably 0.05 mm, and more preferably 0.1 mm. The upper limit of the average thickness of the adhesive layer 30 is preferably 0.3 mm, and more preferably 0.2 mm. When the average thickness of the adhesive layer 30 is less than the lower limit, the adhesive force may be insufficient, and thus the grinding material 1 may be detached from the support. When the average thickness of the adhesive layer 30 is greater than the upper limit, the workability may be impaired. For example, due to the thickness of the adhesive layer 30, it may be difficult to cut the grinding material 1 into a desired shape.

Method for Producing Grinding Material

The grinding material 1 may be produced by the following steps: preparing a grinding layer composition; forming the grinding layer 20 through printing of the grinding layer composition; and overlaying the adhesive layer 30 on the back face side of the base sheet 10.

First, in the step of preparing a grinding layer composition, a solution in which a grinding layer composition (a material for forming the binder 22 and abrasive grains) is dispersed is prepared as a coating liquid. The solvent is not particularly limited as long the material for forming the binder 22 is soluble in the solvent. Specifically, methyl ethyl ketone (MEK), isophorone, terpineol, N-methylpyrrolidone, cyclohexanone, propylene carbonate or the like may be used. A diluent such as water, alcohol, ketone, an acetic acid ester or an aromatic compound may be added in order to adjust the viscosity and fluidity of the coating liquid.

Next, in the step of forming the grinding layer, the coating liquid prepared in the step of preparing the grinding layer composition is used to form the grinding layer 20 on the front face of the base sheet 10 by the printing process such that a plurality of regions divided by the grooves 23 constitute the grinding layer 20. In order to form the grooves 23, a mask having a shape corresponding to the shape of the grooves 23 is provided, and printing of the coating liquid is conducted through the mask. Examples of the printing process include screen printing, metal mask printing, and the like. Then, the coating liquid subjected to printing undergoes dehydration by heating and hardening by heating, whereby the grinding layer 20 is formed. Specifically, the coating liquid may be dried at room temperature (25° C.), and undergo hardening by heating at a temperature of no lower than 100° C. and no higher than 150° C., whereby the grinding layer 20 is formed.

Finally, in the step of overlaying the adhesive layer, the adhesive layer 30 is overlaid on the back face side of the base sheet 10. Specifically, the preformed adhesive layer 30 in a tape form is attached to the back face of the base sheet 10.

Advantages

The grinding material 1 includes the abrasive grains of the plurality of types. With suitable types of abrasive grains selected, the grinding material is capable of attaining desired grinding performance balanced with the production costs. In the grinding material 1, the percentage of the average diameter of the second abrasive grains 21*b* with respect to the average diameter of the first abrasive grains 21*a* is no greater than 70%. Thus, shedding of the first abrasive grains 21*a* out of the grinding layer 20 tends to be preceded by shedding of the second abrasive grains 21*b* of which the average diameter is smaller than the average diameter of the first abrasive grains 21*a*. Meanwhile, in the grinding material 1, the percentage of the average diameter of the second abrasive grains 21*b* with respect to the average diameter of the first abrasive grains 21*a* is no less than 5%. Thus, shedding of the second abrasive grains 21*b* results in an appropriate degree of spalling of part of the grinding layer 20. As a result of the spalling, dulling proceeds on the grinding material 1, causing shedding of the first abrasive grains 21*a* of which the cutting performance has become relatively poor. This allows exposure of fresh abrasive grains. Consequently, the proportion of abrasive grains providing superior cutting performance in the abrasive grains on the front face of the grinding layer 20 is increased, thereby inhibiting a reduction in grinding rate of the grinding material 1 that might otherwise occur in an overly advanced stage of dulling of abrasive grains.

Other Embodiments

The present invention is not limited to the aforementioned embodiments and can be exploited in various modified or improved embodiment other than those described above.

Although the grooves form a grid pattern having equal spacing in the above embodiment, the spacing and the planar shape of the grooves are not limited to those of the grooves in the above embodiment. Although the bottom faces of the grooves correspond to the front face of the base in the above embodiment, the depth of the grooves may be smaller than the average thickness of the grinding layer such that the grooves do not extend to the front face of the base.

In some embodiments, the grinding layer does not have grooves. Despite the omission of grooves, the grinding material is still usable without significant decrease in grinding rate over a relatively long period of time.

Figure 2:
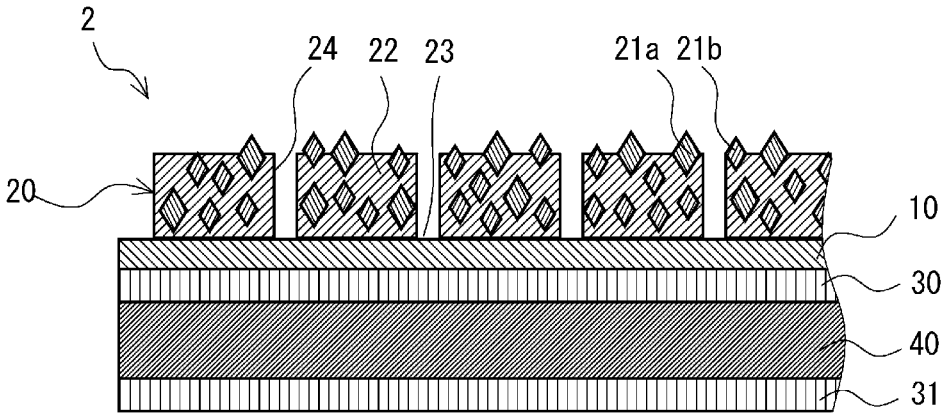
FIG. 2 is a schematic cross-sectional view of a grinding material according to another embodiment of the present invention that is different from the grinding material shown in FIG. 1.

As shown in FIG. 2, a grinding material 2 may include a support 40 overlaid on the adhesive layer 30 on the back face side, and a second adhesive layer 31 overlaid on the back face side of the support 40. When the grinding material 2 includes the support 40, the grinding material 2 is easy to use.

The principal component of the support 40 is exemplified by: thermoplastic resins such as polypropylene, polyethylene, polytetrafluoroethylene and polyvinyl chloride; and engineering plastics such as polycarbonate, polyamide and polyethylene terephthalate. In the case where the support 40 includes such a material as a principal component, the support 40 has flexibility, and thus the grinding material 2 follows the surface profile of the workpiece. As a result, the grinding face can easily come into contact with the workpiece, whereby the grinding rate is further improved.

The average thickness of the support 40 may be, for example, no less than 0.5 mm and no greater than 3 mm. When the average thickness of the support 40 is less than the lower limit, the strength of the grinding material 2 may be insufficient. When the average thickness of the support 40 is greater than the upper limit, it may be difficult to attach the support 40 to a grinding apparatus and/or the flexibility of the support 40 may be insufficient.

The adhesives which may be used as the adhesive layer 30 are also applicable to the second adhesive layer 31. The average thickness of the second adhesive layer 31 may be similar to that of the adhesion layer 30.

In the case where two or more types of abrasive grains have the largest average diameter, all of these abrasive grains are categorized as the first abrasive grains. Similarly, in the case where two or more types of abrasive grains have the second largest average diameter, all of these abrasive grains are categorized as the second abrasive grains.

EXAMPLES

Hereinafter, the present invention will be explained in more detail by way of Examples and Comparative Examples, but the present invention should not be construed as being limited to the following Examples.

Example 1

A composition was prepared by adding a diluent (isophorone), a hardening agent and a catalytic hardener to an epoxy resin. The composition was mixed with monocrystalline diamond abrasive grains (average diameter: 9 μm) as the first abrasive grains and alumina abrasive grains (average diameter: 2.0 μm) as the second abrasive grains in such a manner that the content of the first abrasive grains in the grinding layer was 20% by volume and the content of the second abrasive grains in the grinding layer was 32% by volume, whereby a coating liquid was obtained.

A PET film having an average thickness of 75 μm was provided as a base sheet. A grinding layer was formed on the front face of the base sheet by the printing process using the coating liquid. A mask that matched with grooves was used as a pattern for the printing, whereby protruding portions divided by the grooves were formed on the grinding layer. The grooves were formed into a grid pattern having an average width of 1 mm, and the protruding portions were formed into a square measuring 1.5 mm per side in a planar view (average area: 2.25 $mm^2$). The percentage area occupancy of the upper faces of the protruding portions with respect to the entirety of the grinding layer was 36%. The grinding layer had an average thickness of 300 μm.

The coating liquid was dried at room temperature (25° C.), and underwent hardening by heating at 120° C.

A rigid vinyl chloride resin plate having an average thickness of 1 mm was used as a support for supporting the base sheet and fixing it to a grinding apparatus. The back face of the base and the front face of the support were bonded together with a tacky adhesive having an average thickness of 130 μm. A double-sided tape was used as the tacky adhesive. Accordingly, the grinding material of Example 1 was obtained.

Example 2

The composition identical to the composition of Example 1 was mixed with monocrystalline diamond abrasive grains (average diameter: 9 μm) as the first abrasive grains and alumina abrasive grains (average diameter: 5.7 μm) as the second abrasive grains in such a manner that the content of the first abrasive grains in the grinding layer was 5% by volume and the content of the second abrasive grains in the grinding layer was 60% by volume, whereby a coating liquid was obtained.

The grinding material of Example 2 was obtained as in Example 1 except that the aforementioned coating liquid was used.

Example 3

The composition identical to the composition of Example 1 was mixed with monocrystalline diamond abrasive grains (average diameter: 12 μm) as the first abrasive grains and alumina abrasive grains (average diameter: 2.0 μm) as the second abrasive grains in such a manner that the content of the first abrasive grains in the grinding layer was 2.5% by volume and the content of the second abrasive grains in the grinding layer was 55% by volume, whereby a coating liquid was obtained.

A grinding layer was formed on the front face of the base sheet as in Example 1 by using the aforementioned coating liquid. The grooves of the grinding layer were formed into a grid pattern having an average width of 5 mm, and the protruding portions were formed into a square measuring 2.5 mm per side in a planar view (average area: 6.25 $mm^2$). The percentage area occupancy of the upper faces of the protruding portions with respect to the entirety of the grinding layer was 11.1%.

The base sheet was fixed to the support as in Example 1, whereby the grinding material of Example 3 was obtained.

Example 4

The composition identical to the composition of Example 1 was mixed with monocrystalline diamond abrasive grains (average diameter: 12 μm) as the first abrasive grains, alumina abrasive grains (average diameter: 2.0 μm) as the second abrasive grains, and silica abrasive grains (average diameter: 0.040 μm) as the third abrasive grains in such a manner that the content of the first abrasive grains in the grinding layer was 2.5% by volume, the content of the second abrasive grains in the grinding layer was 50% by volume, and the content of the third abrasive grains in the grinding layer was 5% by volume, whereby a coating liquid was obtained.

The grinding material of Example 4 was obtained as in Example 3 except that the aforementioned coating liquid was used.

Example 5 and 12 to 14

The composition identical to the composition of Example 1 was mixed with monocrystalline diamond abrasive grains (average diameter: 9 μm) as the first abrasive grains and alumina abrasive grains (average diameter: 2.0 μm) as the second abrasive grains in such a manner that the content of the first abrasive grains in the grinding layer was 5% by volume and the content of the second abrasive grains in the grinding layer was 60% by volume, whereby a coating liquid was obtained.

The grinding materials of Examples 5 and 12 to 14 were obtained as in Example 1 except that the aforementioned coating liquid was used.

Example 6

The composition identical to the composition of Example 1 was mixed with monocrystalline diamond abrasive grains (average diameter: 9 μm) as the first abrasive grains, alumina abrasive grains (average diameter: 2.0 μm) as the second abrasive grains, and ceria abrasive grains (average diameter: 1.2 μm) as the third abrasive grains in such a manner that the content of the first abrasive grains in the grinding layer was 5% by volume, the content of the second abrasive grains in the grinding layer was 48% by volume, and the content of the third abrasive grains in the grinding layer was 12% by volume, whereby a coating liquid was obtained.

The grinding material of Example 6 was obtained as in Example 1 except that the aforementioned coating liquid was used.

Example 7

The composition identical to the composition of Example 1 was mixed with monocrystalline diamond abrasive grains (average diameter: 9 μm) as the first abrasive grains and alumina abrasive grains (average diameter: 2.0 μm) as the second abrasive grains in such a manner that the content of the first abrasive grains in the grinding layer was 5% by volume and the content of the second abrasive grains in the grinding layer was 55% by volume, whereby a coating liquid was obtained.

The grinding material of Example 7 was obtained as in Example 1 except that the aforementioned coating liquid was used.

Example 8

The composition identical to the composition of Example 1 was mixed with monocrystalline diamond abrasive grains (average diameter: 9 μm) as the first abrasive grains and alumina abrasive grains (average diameter: 2.0 μm) as the second abrasive grains in such a manner that the content of the first abrasive grains in the grinding layer was 5% by volume and the content of the second abrasive grains in the grinding layer was 75% by volume, whereby a coating liquid was obtained.

The grinding material of Example 8 was obtained as in Example 1 except that the aforementioned coating liquid was used.

Example 9

The composition identical to the composition of Example 1 was mixed with monocrystalline diamond abrasive grains (average diameter: 14 μm) as the first abrasive grains and alumina abrasive grains (average diameter: 2.0 μm) as the second abrasive grains in such a manner that the content of the first abrasive grains in the grinding layer was 5% by volume and the content of the second abrasive grains in the grinding layer was 60% by volume, whereby a coating liquid was obtained.

The grinding material of Example 9 was obtained as in Example 1 except that the aforementioned coating liquid was used.

Example 10

The composition identical to the composition of Example 1 was mixed with polycrystalline diamond abrasive grains (average diameter: 9 μm) as the first abrasive grains and alumina abrasive grains (average diameter: 2.0 μm) as the second abrasive grains in such a manner that the content of the first abrasive grains in the grinding layer was 5% by volume and the content of the second abrasive grains in the grinding layer was 55% by volume, whereby a coating liquid was obtained.

The grinding material of Example 10 was obtained as in Example 1 except that the aforementioned coating liquid was used.

Example 11

The composition identical to the composition of Example 1 was mixed with polycrystalline diamond abrasive grains (average diameter: 15 μm) as the first abrasive grains and alumina abrasive grains (average diameter: 2.0 μm) as the second abrasive grains in such a manner that the content of the first abrasive grains in the grinding layer was 5% by volume and the content of the second abrasive grains in the grinding layer was 55% by volume, whereby a coating liquid was obtained.

The grinding material of Example 11 was obtained as in Example 1 except that the aforementioned coating liquid was used.

Comparative Examples 1 and 5

The composition identical to the composition of Example 1 was mixed with monocrystalline diamond abrasive grains (average diameter: 9 μm) in such a manner that the content of the diamond abrasive grains in the grinding layer was 45% by volume, whereby a coating liquid was obtained.

The grinding materials of Comparative Examples 1 and 5 were obtained as in Example 1 except that the aforementioned coating liquid was used.

Comparative Example 2

The composition identical to the composition of Example 1 was mixed with monocrystalline diamond abrasive grains (average diameter: 9 μm) as the first abrasive grains and boron carbide (average diameter: 6.7 μm) as the second abrasive grains in such a manner that the content of the first abrasive grains in the grinding layer was 5% by volume and the content of the second abrasive grains in the grinding layer was 60% by volume, whereby a coating liquid was obtained.

The grinding material of Comparative Example 2 was obtained as in Example 1 except that the aforementioned coating liquid was used.

Comparative Example 3

The composition identical to the composition of Example 1 was mixed with alumina abrasive grains (average diameter: 15 μm) in such a manner that the content of the alumina abrasive grains in the grinding layer was 71% by volume, whereby a coating liquid was obtained.

The grinding material of Comparative Example 3 was obtained as in Example 1 except that the aforementioned coating liquid was used.

Comparative Example 4

The composition identical to the composition of Example 1 was mixed with monocrystalline diamond abrasive grains (average diameter: 9 μm) as the first abrasive grains and alumina abrasive grains (average diameter: 0.3 μm) as the second abrasive grains in such a manner that the content of the first abrasive grains in the grinding layer was 5% by volume and the content of the second abrasive grains in the grinding layer was 47% by volume, whereby a coating liquid was obtained.

The grinding material of Comparative Example 4 was obtained as in Example 1 except that the aforementioned coating liquid was used.

Grinding Conditions

A glass substrate was ground by using each of the grinding materials obtained in Examples 1 to 14 and Comparative Example 1 to 5. In the grinding actions performed in Examples 1 to 11 and Comparative Examples 1 to 4, synthetic quartz glass having a diameter of 5.08 cm and a specific gravity of 2.19 was used as the glass substrate. In the grinding action performed in Example 12, soda lime glass having a diameter of 6.25 cm and a specific gravity of 2.4 was used as the glass substrate. In the grinding actions performed in Examples 13 to 14 and Comparative Example 5, a borosilicate glass having a diameter of 6.25 cm and a specific gravity of 2.34 was used as the glass substrate.

In the grinding actions, a commercially available double side grinder was used. The carrier of the double side grinder was a vinyl chloride resin plate. The carrier used to grind a synthetic quartz glass had an average thickness of 0.6 mm and the carrier used to grind a soda line glass and a borosilicate glass was 0.8 mm. The grinding action was performed four times, and each grinding action was performed for 10 min, with the upper surface plate running at a rotational frequency of 40 rpm, the lower surface plate running at a rotational frequency of 60 rpm, and the SUN gear running at a rotational frequency of 30 rpm. The grinding pressure was as shown in Table 1. In this process, "GC-50P" available from Noritake Co., Limited was diluted 30-fold with water, and the diluted solution was supplied as a coolant at a feed rate of 120 cc/min.

TABLE 1

| | First abrasive grains | | | Second abrasive grains | | | Third abrasive grains | | | Percentage of diameter of second abrasive grains (%) | Total content of abrasive grains (% by volume) | Workp-iece — | Grinding pressure (g/cm$^2$) |
|---|---|---|---|---|---|---|---|---|---|---|---|---|---|
| | type — | diam-eter (μm) | content (% volume) | type — | diam-eter (μm) | content (% volume) | type — | diam-eter (μm) | content (% by volume) | | | | |
| Example 1 | monocrys-talline diamond | 9 | 20 | alumina | 2 | 32 | — | — | — | 22 | 52 | quartz glass | 100 |
| Example 2 | monocrys-talline diamond | 9 | 5 | alumina | 5.7 | 60 | — | — | — | 63 | 65 | quartz glass | 100 |
| Example 3 | monocrys-talline diamond | 12 | 2.5 | alumina | 2 | 55 | — | — | — | 17 | 57.5 | quartz glass | 100 |
| Example 4 | monocrys-talline diamond | 12 | 2.5 | alumina | 2 | 50 | silica | 0.04 | 5 | 17 | 57.5 | quartz glass | 100 |
| Example 5 | monocrys-talline diamond | 9 | 5 | alumina | 2 | 60 | — | — | — | 22 | 65 | quartz glass | 100 |
| Example 6 | monocrys-talline diamond | 9 | 5 | alumina | 2 | 48 | ceria | 1.2 | 12 | 22 | 65 | quartz glass | 100 |
| Example 7 | monocrys-talline diamond | 9 | 5 | alumina | 2 | 55 | — | — | — | 22 | 60 | quartz glass | 100 |
| Example 8 | monocrys-talline diamond | 9 | 5 | alumina | 2 | 75 | — | — | — | 22 | 80 | quartz glass | 100 |
| Example 9 | monocrys-talline diamond | 14 | 5 | alumina | 2 | 60 | — | — | — | 14 | 65 | quartz glass | 100 |
| Example 10 | polycryst-alline diamond | 9 | 5 | alumina | 2 | 55 | — | — | — | 22 | 60 | quartz glass | 100 |
| Example 11 | polycryst-alline diamond | 15 | 5 | alumina | 2 | 55 | — | — | — | 13 | 60 | quartz glass | 100 |
| Example 12 | monocrys-talline diamond | 9 | 5 | alumina | 2 | 60 | — | — | — | 22 | 65 | soda lime | 200 |
| Example 13 | monocrys-talline diamond | 9 | 5 | alumina | 2 | 60 | — | — | — | 22 | 65 | borosil-icate glass | 200 |
| Example 14 | monocrys-talline diamond | 9 | 5 | alumina | 2 | 60 | — | — | — | 22 | 65 | borosil-icate glass | 100 |
| Comparative Example 1 | monocrys-talline diamond | 9 | 45 | — | — | — | — | — | — | — | 45 | quartz glass | 100 |

TABLE 1-continued

| | First abrasive grains | | | Second abrasive grains | | | Third abrasive grains | | | Percentage of diameter of second abrasive grains (%) | Total content of abrasive grains (% by volume) | | |
|---|---|---|---|---|---|---|---|---|---|---|---|---|---|
| | type — | diameter (μm) | content (% volume) | type — | diameter (μm) | content (% volume) | type — | diameter (μm) | content (% by volume) | | | Workp-iece — | Grinding pressure (g/cm$^2$) |
| Comparative Example 2 | monocrys-talline diamond | 9 | 5 | boron carbide | 6.7 | 60 | — | — | — | 74 | 65 | quartz glass | 100 |
| Comparative Example 3 | alumina | 15 | 71 | — | — | — | — | — | — | — | 71 | quartz glass | 100 |
| Comparative Example 4 | monocrys-talline diamond | 9 | 5 | alumina | 0.3 | 47 | — | — | — | 3 | 52 | quartz glass | 100 |
| Comparative Example 5 | monocrys-talline diamond | 9 | 45 | — | — | — | — | — | — | — | 45 | borosil-irate glass | 200 |

Evaluation Procedures

The glass substrates ground by using the grinding materials of Examples 1 to 14 and Comparative Example 1 to 5, respectively, were evaluated as described below. The results are shown in Table 2.

Surface Finish Roughness

The measurement of surface finish roughness Ra was conducted at six points in total including randomly selected three points on the front face and randomly selected three points on the back face by using a commercially available contact surface roughness meter operating at a feed rate of 0.5 mm/sec, a measuring range of 0.08 mm and a measuring length of 4.8 mm, and the average of the obtained measurement values was taken.

Grinding Rate

The glass substrate was ground for 15 minutes and the grinding rate was determined by dividing the pre-ground/post-ground change in weight (g) by the surface area (cm$^2$) of the substrate, the specific gravity (g/cm$^3$) of the substrate and the grinding time period (min), and converting the resultant unit into μm/min.

Processing Stability

With the grinding action performed four times in total, the processing stability was determined by dividing the grinding rate in the fourth grinding action by the grinding rate in the first grinding action.

The processing stability was evaluated on a scale of 4 in accordance with the following criteria.

Criteria for Assessment of Processing Stability

A: no less than 80%

B: no less than 75% and less than 80%

C: less than 75%

D: measurement failed due to wearing out of the grinding layer

TABLE 2

| | Ra (μm) | Grinding rate: first grinding action (μm/min) | second grinding action (μm/min) | third grinding action (μm/min) | fourth grinding action (μm/min) | Processing stability (%) | Assessment — |
|---|---|---|---|---|---|---|---|
| Example 1 | 0.117 | 7.38 | 6.97 | 6.38 | 5.80 | 79 | B |
| Example 2 | 0.113 | 4.87 | 5.55 | 5.10 | 5.40 | 111 | A |
| Example 3 | 0.124 | 5.68 | 6.53 | 6.17 | 6.44 | 113 | A |
| Example 4 | 0.113 | 5.60 | 5.10 | 5.61 | 5.34 | 95 | A |
| Example 5 | 0.097 | 6.10 | 6.61 | 6.17 | 6.00 | 98 | A |
| Example 6 | 0.108 | 6.19 | 5.80 | 5.52 | 5.73 | 93 | A |
| Example 7 | 0.111 | 6.11 | 6.32 | 6.18 | 6.05 | 99 | A |
| Example 8 | 0.111 | 6.15 | 6.35 | 6.21 | 6.09 | 99 | A |
| Example 9 | 0.131 | 8.06 | 7.42 | 7.32 | 7.24 | 90 | A |
| Example 10 | 0.072 | 4.21 | 4.39 | 4.27 | 3.63 | 86 | A |
| Example 11 | 0.098 | 6.49 | 6.69 | 6.54 | 6.12 | 94 | A |
| Example 12 | 0.080 | 2.00 | 1.91 | 1.82 | 2.08 | 104 | A |
| Example 13 | 0.160 | 12.41 | 11.76 | 11.58 | 11.92 | 96 | A |
| Example 14 | 0.120 | 8.14 | 8.18 | 8.03 | 7.54 | 93 | A |
| Comparative Example 1 | 0.114 | 6.27 | 4.92 | 4.24 | 3.65 | 58 | C |
| Comparative Example 2 | 0.114 | 2.13 | 1.57 | 1.01 | 0.76 | 36 | C |
| Comparative Example 3 | 0.092 | 2.09 | 1.64 | 1.41 | 1.21 | 58 | C |
| Comparative Example 4 | 0.110 | 6.54 | 6.01 | worn out | — | — | D |
| Comparative Example 5 | 0.16 | 12.98 | 12.12 | 11.53 | 9.52 | 73 | C |

In Table 2, "worn out" and the symbol "-" entered in the grinding rate section means a failure to determine the grinding rate due to wearing out of the grinding layer. The symbol "-" entered in the processing stability section means that a failure to determine the processing stability due to a failure to determine the grinding rate in the fourth grinding action.

The results shown in Table 2 indicate that the grinding materials of Examples 1 to 14 are comparable in the grinding rate in the first grinding action and the surface finish roughness to the grinding materials of Comparative Examples 1 to 5, and are superior in processing stability. In contrast, the grinding materials of Comparative Examples 1, 3 and 5 are inferior in processing stability. The grinding materials of Comparative Examples 1, 3 and 5 included only one type of abrasive grains, which presumably became dull. The grinding material of Comparative Example 2 was inferior in processing stability, and was also inferior in grinding rate to the grinding materials of Examples 2 and 5 to 8, which were comparable in the average diameter and the content of the first abrasive grains to the grinding material of Comparative Example 2. In the grinding material of Comparative Example 2, the percentage of the average diameter of the second abrasive grains with respect to the average diameter of the first abrasive grains is greater than 70%. Thus, the degree of spalling of the grinding layer caused by shedding of the second abrasive grains was presumably insufficient, leading to the insufficient processing stability of the grinding material of Comparative Example 2. Furthermore, the grinding material of Comparative Example 2 exhibited a low grinding rate presumably because the grinding pressure applied on the first abrasive grains was alleviated by the second abrasive grains which also received the grinding pressure during the grinding action. The grinding layer of the grinding material of Comparative Example 4 was worn out in the third grinding action. In the grinding material of Comparative Example 4, the percentage of the average diameter of the second abrasive grains with respect to the average diameter of the first abrasive grains was less than 5%. Thus, shedding of the second abrasive grains presumably occurred excessively, resulting in a quick progression of spalling of the grinding layer.

When comparisons are made among Examples 1, 5, 7 and 8 in which the first abrasive grains of the same type and the same average diameter and the second abrasive grains of the same type and the same average diameter were used, the grinding materials of Examples 5, 7 and 8 in which the total content of abrasive grains was no less than 55% by volume were superior in processing stability. This means that the total content of abrasive grains is more preferably no less than 55% by volume.

When comparisons were made among Examples 2, 5 and 9 which were equal in terms of the content of the first abrasive grains and the content of the second abrasive grains, Example 5 in which the percentage of the average diameter of the second abrasive grains with respect to the average diameter of the first abrasive grains was no less than 15% and no greater than 25% was superior in grinding rate to Example 2 and was superior in processing stability to Example 9. This means that the percentage of the average diameter of the second abrasive grains with respect to the average diameter of the first abrasive grains is more preferably no less than 15% and no greater than 25%.

Comparisons made between Examples 7 and 10 and between Examples 9 and 11 indicate that superior processing stability was obtained regardless of whether the diamond abrasive grains were monocrystalline or polycrystalline. This means that regardless of which type of abrasive grains is used, superior processing stability is obtained in the case where the percentage of the average diameter of the second abrasive grains with respect to the average diameter of the first abrasive grains falls within the predetermined range. More specifically, monocrystalline diamonds were revealed to have a higher grinding rate and provide superior cutting performance. Meanwhile, polycrystalline diamonds were revealed to be superior in processing stability because they can resist dulling through repeated exposure of fresh crystal faces caused by cleavage between microcrystals.

A comparison between Examples 12 and 13 indicates that superior processing stability was obtained regardless of what kind of workpiece was used. A comparison between Examples 13 and 14 indicates that superior processing stability was obtained irrespective of the grinding pressure. This means that superior processing stability is obtained irrespective of grinding conditions in the case where the percentage of the average diameter of the second abrasive grains with respect to the average diameter of the first abrasive grains falls within the predetermined range.

INDUSTRIAL APPLICABILITY

The grinding material according to the present invention is usable without significant decrease in grinding rate over a relatively long period of time. Therefore, the grinding material can be suitably used for surface grinding of a substrate made of glass or the like.

The invention claimed is:

1. A grinding material comprising: a base sheet; and a grinding layer overlaid on a front face side of the base sheet and comprising abrasive grains and a binder for the abrasive grains, wherein the abrasive grains are fixed, the abrasive grains comprise first abrasive grains and second abrasive grains, the first abrasive grains have a largest average diameter of the abrasive grains and the second abrasive grains have a second largest average diameter of the abrasive grains, and a percentage of an average diameter of the second abrasive grains with respect to an average diameter of the first abrasive grains is no less than 5% and no greater than 70%, the average diameter of the first abrasive grains is no less than 2 um and no greater than 45 pm, the average diameter of the second abrasive grains is no less than 1 um and no greater than 20 um, and the first abrasive grains are diamond abrasive grains and the second abrasive grains are alumina abrasive grains, a content of the first abrasive grains in the grinding layer is no less than 1% by volume and no greater than 15% by volume, and a content of the second abrasive grains in the grinding layer is no less than 50% by volume and no greater than 80% by volume.

2. The grinding material according to claim 1, wherein a total content of the abrasive grains in the grinding layer is no less than 50% by volume and no greater than 85% by volume.

3. The grinding material according to claim 1, wherein the base sheet is a flexible material.

4. The grinding material according to claim 1, wherein the grinding layer comprises a plurality of protruding portions, and an average area of the upper faces of the plurality of protruding portions is no less than 1 $mm^2$ and no greater than 150 $mm^2$.

5. The grinding material according to claim 1, wherein the binder comprises polyacrylic acid, epoxy, polyester or polyurethane, as a principal component.

6. The grinding material according to wherein the abrasive grains comprise third abrasive grains, and a percentage of an average diameter of the third abrasive grains with respect to the average diameter of the second abrasive grains is no less than 1% and no greater than 75%.

7. The grinding material according to claim 6, wherein the average diameter of the third abrasive grains is no less than 0.01 μm and no greater than 2 μm.

8. The grinding material according to claim 6, wherein a content of the third abrasive grains in the grinding layer is no less than 1% by volume and no greater than 20% by volume.

* * * * *